United States Patent [19]

Schoon

[11] Patent Number: 4,872,559

[45] Date of Patent: Oct. 10, 1989

[54] DISPENSER FOR MEDICAL PREPARATIONS

[75] Inventor: Hinrich Schoon, Tollarp, Sweden

[73] Assignee: Preci-Plast AB, Tollarp, Sweden

[21] Appl. No.: 198,119

[22] Filed: May 24, 1988

Related U.S. Application Data

[63] Continuation-in-part of Ser. No. 68,628, Jun. 30, 1987.

[30] Foreign Application Priority Data

Dec. 29, 1987 [SE] Sweden ..... 8705178

[51] Int. Cl.[4] ..... A65D 83/04

[52] U.S. Cl. ..... 206/538; 206/534; 206/539; 206/561

[58] Field of Search ..... 206/538, 539, 534, 561; 116/121, 135

[56] References Cited

U.S. PATENT DOCUMENTS

| | | | |
|---|---|---|---|
| 611,136 | 9/1898 | Mason | 206/538 |
| 2,410,923 | 11/1946 | Beardsley | 206/538 |
| 4,038,937 | 8/1977 | Moe | 206/538 |
| 4,062,445 | 12/1977 | Moe | 206/538 |
| 4,693,371 | 9/1987 | Malpass | 206/538 |

*Primary Examiner*—Joseph Man-Fu Moy
*Attorney, Agent, or Firm*—Ladas & Parry

[57] ABSTRACT

A dispenser for medical preparations in tablet form. The dispenser has a body for housing an insert having compartments arranged in rows, one row for each day of the week and four compartments in each row, one compartment for a specific time of the day and housing one intake of tablets. Over each row is a recess and in each recess is arranged a slidable cover for covering and uncovering the compartments. The dispenser comprises a novel removable cap of elastic material that snaps in an opening formed in a transverse side of the body. When the cap is removed the insert can be extracted and refilled with new tablets.

9 Claims, 3 Drawing Sheets

DISPENSER FOR MEDICAL PREPARATIONS

This application is a continuation-in-part of application Ser. No. 068,628, filed Jun. 30, 1987.

TECHNICAL FIELD

The present invention relates to a dispenser for medical preparations in tablet form, of the type that shall be taken at certain times on the day and over one week.

PRIOR ART

In U.S. Pat. No. US-A-3,537,422 there is disclosed such a dispenser having a body in which a plurality of compartments are defined, covers for covering and uncovering said compartments, and detent means for retaining the cover in successive positions sequentially covering and uncovering said compartments.

The medical preparations such as tablets are placed in the compartments corresponding to the day of the week and the time of the day the relevant tablet or tablets should be taken.

In German Offenlegungsschrift DE-A-27 34 664 there is disclosed a development of the above-mentioned dispenser, the improvement being that the tablets etc are placed in a plastic insert, which in turn is placed in a drawer, which is inserted in the body. Such insert and drawer replaces the compartments in the body according to U.S. Pat. No. US-A-3,537,422 and makes it possible to package the insert at the drug-store, whereupon the user inserts the insert and drawer in the body for the relevant week. The insert is assymetrical for preventing insertion thereof in the wrong direction.

The above-mentioned dispenser may be improved in certain respects. The covers are maintained in their closed positions only by the force of the detent means. A child can easily open such a dispenser and gain access to the tablets. Thus, said dispenser is not child-proof. Also, if such a dispenser is carried in the pocket of the user, there is a risk that the detent means will not excert a sufficient force for maintaining the cover in the closed position, whereby there is a risk that the cover will open and the tablets will come loose.

Moreover, said dispenser is unnecessarily expensive, while the drawer only performs the function of enclosing the insert during the insertion thereof in the body. Such a drawer seems to be superfluous.

SUMMARY OF THE INVENTION

The object of the present invention is to solve the above-mentioned drawbacks and provide an improved dispenser of the type mentioned above.

Thus, there is provided a dispenser for medical preparations, such as in tablet form, of the type that shall be taken at certain times on the day and over some days, such as a week. The dispenser comprises a rectangular body having two longitudinal sides, two transversal sides, a bottom and an upper surface. The longitudinal and transversal sides are inclined so that the bottom surface is somewhat smaller than the upper surface. Said sides and bottom surface may be transparent while the upper surface carries time indications. The upper surface comprises several recesses each covered by a cover, which is slidable in grooves in the upper surface to be extractable in one transverse direction. Moreover, the dispenser comprises an insert having several rows of compartments, each row being positioned below a corresponding recess in the body and housing said medical preparations.

According to the invention, the body comprises a cap closing an opening in one of the transversal sides. The cap is removable for allowing insertion and removal of an insert through said opening in the transversal side of the body. The body comprises a locking means for locking all of said covers in the closed positions thereof, and for unlocking all covers at the same time.

Preferably, the cap comprises a shoulder at each end thereof. Moreover, the transversal side of the body comprises two edges adapted for retaining the cap by the shoulders thereof in the closed position and the cap being elastic for being pressed inwards so that the corresponding shoulder can pass inside the edge and the cap can be pushed in the transverse direction for making the other shoulder at the other end of the cap free from the corresponding other edge for removal of the cap. The body may be provided with two rest posts for cooperation with the cap and assisting in bending the cap for removal thereof. Alternatively, the may be provided with two lugs for cooperation with the body in a similar way.

Preferably, the locking means is a longitudinal beam comprising several shoulders, one for each cover, cooperating with a corresponding recess of each cover, said beam being movable in the longitudinal direction for moving the shoulders from said cooperation with said recesses and thereby releasing the covers from their locked position. Each cover may comprise a chamfered portion, which upon pushing the cover into the closed position cooperates with the beam for allowing the beam to pass the cover to the closed position and locking it there.

BRIEF DESCRIPTION OF THE DRAWINGS

The present invention is described more in detail below by means of a preferred embodiment and by reference to the enclosed drawings.

DETAILED DESCRIPTION OF THE PREFERRED EMBODIMENTS

Figure 1A:
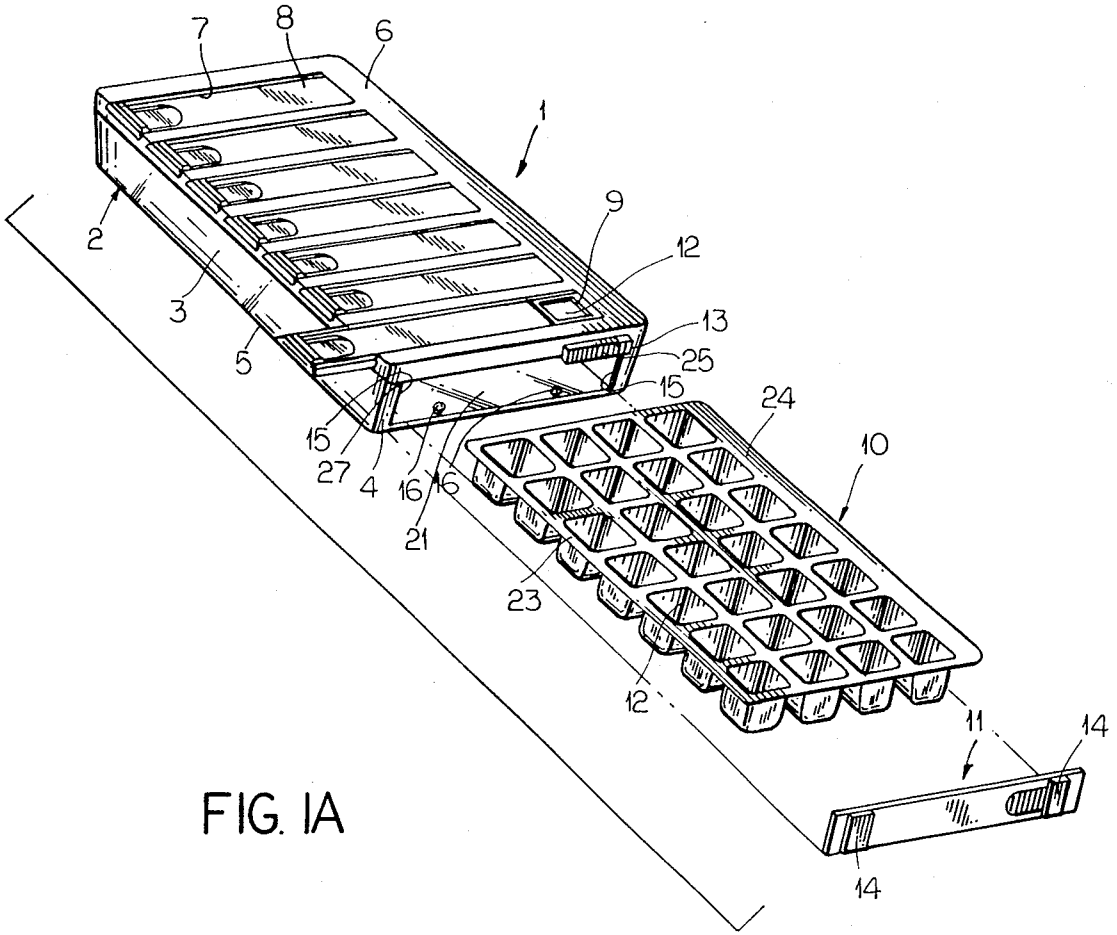
FIG. 1*a* is a perspective view of a first embodiment of the dispenser according to the invention partially exploded.

In FIG. 1*a* there is shown a perspective view of the first embodiment of the present invention. The dispenser 1 comprises a body 2 having a generally rectangular form and having two longitudinal sides 3, two transversal sides 4, a bottom 5 and an upper surface 6. The upper surface comprises seven recesses 7 each covered by a cover 8. Each cover 8 is slidable in grooves 9 in the upper surface 6 to be extractable in the transverse direction as shown for the right cover in FIG. 1a. Each cover 8 has detent means on the underside thereof in the form of projections, which ride on longitudinal ridges 26 between the compartments. So far, the dispenser according to the invention corresponds to the dispenser according to prior art.

Inside the body 2 there is positioned an insert 10, which is completely enclosed by the body 2 and is inserted therein from one of the transversal sides shown to the right in FIG. 1*a*, which side comprises a removable cap 11 shown removed in FIG. 1*a*.

The insert comprises compartments 12 arranged in seven rows with four compartments in each row located under each recess 7, when inserted in the body 2. The insert 10 has two edges 23, 24 at the top surface, one of which 24 is wider than the other.

Figure 5:
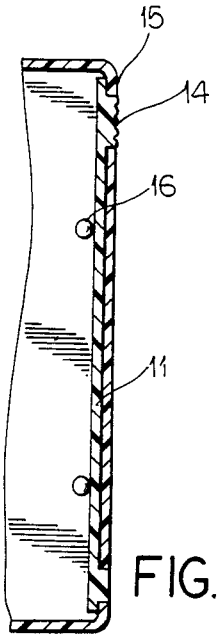
FIG. 5 is plan view in cross-section of the cap shown in FIG. 1*a*.

The cap 11 is made of an elastic material, such as polycarbonate, and comprises a projection or shoulder 14 at each end thereof. One of the shoulders 14 may be provided with serrations, as shown in FIG. 5, or an area adjacent said shoulder may be serrated, as shown in FIG. 1a, which facilitates the operation of the cap.

A locking means 13 is located immediately below the covers 8 for locking the same in their closed positions. The locking means 13 comprises a longitudinal beam 17 having shoulders 18, one for each cover, for engagement with a corresponding recess 19 in each cover 8.

Figure 2:
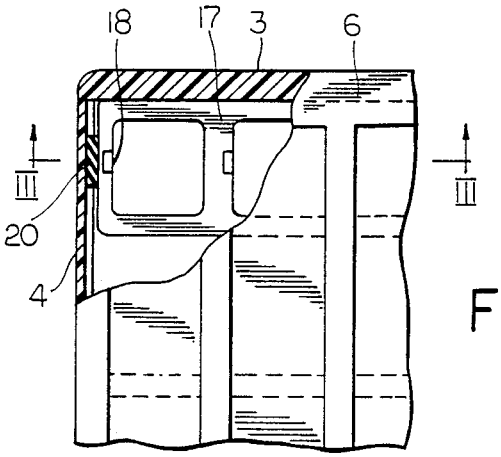
FIG. 2 is a plan view partially in cross-section of a portion of the dispenser shown in FIGS. 1*a* and 1*b*.

The locking beam 17 is biased to the right, as viewed in FIG. 2, into the locking position by a resilient means 20. In this embodiment the resilient means is a piece of compressible rubber or elastomer, but it is understood that other means are possible, such as coil or leaf springs. The locking beam 17 is pushed to the left, as viewed in FIG. 2, to the release position by depressing a push button portion 25 projecting on the outside of the body 2.

Figure 3:
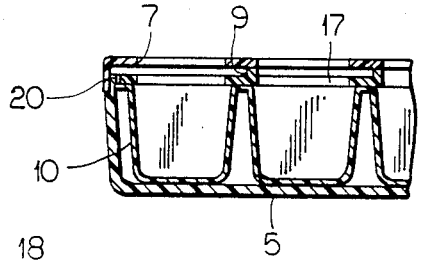
FIG. 3 is a cross-section view according to line III—III in FIG. 2.

The sides 3, 4 of the body 2 are inclined, as may be seen in FIG. 3, and the corners are rounded, so that the dispenser is more comfortable to hold. Moreover, the sides 3, 4 and the bottom 5 are transparent, so that cards containing information of the identity of the user, prescriptions etc are readable through the sides 3, 4 and the bottom 5. Said cards (not shown) are accomodated between the insert 10 and said sides 3, 4 and bottom 5, respectively.

The covers 8 and the longitudinal beam 17 are made of polycarbonate, which is an elastic, transparent and low friction material. The covers 8 and the longitudinal beam 17 are slidable in grooves in the upper surface 6, which is made of styrene that is a harder material than polycarbonate. Thus, it is the covers 8 and the beam 17 that are subjected to abrasive wear, which parts are available as spare parts. The remainder of the body 2, i.e. the sides 3, 4 and the bottom 5, is made of transparent material, preferably polycarbonate.

The operation of the dispenser in accordance with the first embodiment of the invention is as follows. The insert 10 is supplied with tablets in accordance with the relevant medical treatment in a conventional manner, each compartment 12 corresponding to a certain time of day, and each row of compartments corresponding to one day of the week. The days and times are indicated on the upper surface 6 of the body (not shown in the drawings). The insert 10 is then pushed into the body 2 through the opening 21 in the short side with the edges 23, 24 sliding in grooves in the body (the left narrow groove 27 shown in FIG. 1*a*). Because of the differently dimensioned edges 23, 24 of the insert 10 and the alignment of the spaces between compartments 12 and rest posts 16 it is impossible to insert it the wrong way. More particularly, rest posts 16, which are protuberances on the interior surface of side 5 of body 2, act as vertical orienting surfaces for insert 10. Consequently, if insert 10 is oriented the wrong way the rest posts 16 will not register with the spaces between the compartments and the wide edge 24 will not completely extend into the narrow groove 27.

After the insert 10 is positioned in the body 2 the removable cap 11 is applied by inserting one end thereof into the opening with the shoulder 14 entering behind the edge 15 of the body and then bending the cap 11 with one of the rest posts as a fulcrum, so that the other end of the cap 11 passes by the other edge 15 of the body 2, cf FIG. 5. The cap 11 is then moved transversely so that the shoulder 14 snaps out from behind the edge 15 and the tip of the other end of the cap is located inside the other edge of the body. The cap is now in its closed position, as shown in FIG. 5, and the dispenser is ready for use.

Figure 4:
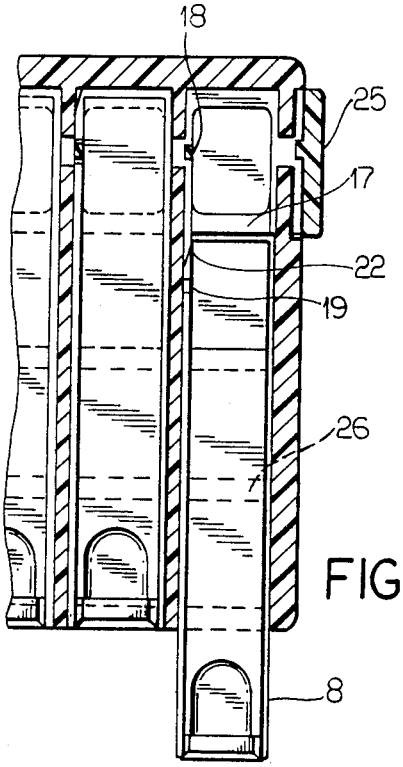
FIG. 4 is a plan view in cross-section of another portion of the dispenser shown in FIGS. 1*a* and 1*b*.

When it is time for the tablets to be taken the push button portion 25 of the locking beam 13 is depressed to release the covers 8 and the proper cover is simultameously pulled out with the detent means (not shown) riding over the longitudinal ridges 26 between the compartments to uncover the desired compartment, cf FIG. 4. When the tablets have been taken the cover 8 is simply pushed back without having to depress the push button portion since a chamfered portion 22 of the cover engages the shoulder 18 and moves the beam 17 against the resistance of the resilient means 20. The cover is pushed further until the shoulder 18 snaps into the recess 19 in the cover 8 and the cover is again locked.

After a week, when the tablets are finished, and the dispenser is to be refilled, the cap 11 is removed by depressing one end and moving it transversely, so that one of the shoulders 14 enters inside the edge 15 at one side of the body and the tip of the other end of the cap 11 is released from the other edge 15 and swings out of the opening 21. Then the first end may be withdrawn from inside the edge 15 and the cap 11 completely removed. The insert 10 now can be extracted and refilled.

Preferably, the shoulder 14 having serrations is entered inside the edge 15. The body may be asymmetric and having said edge 15 positioned at a longer distance from the longitudinal side compased to the other edge 15. However, the edges may also be symmetrically positoned.

Figure 1B:
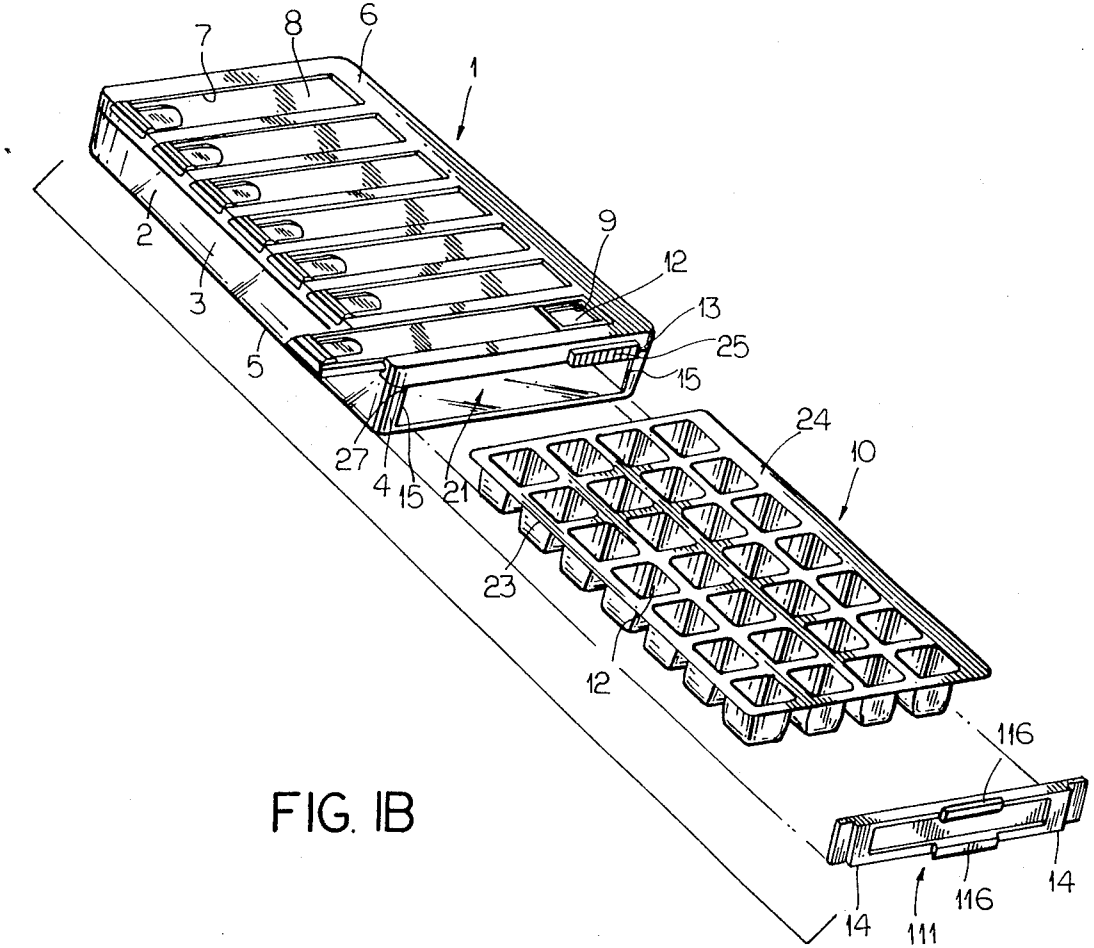
FIG. 1*b* is a perspective view of a second embodiment of the dispenser according to the invention.

In FIG. 1*b* a second preferred embodiment of the present invention is shown, wherein like parts are designated by the same reference numerals as in FIG. 1*a*. The second embodiment of the invention is identical with the first embodiment except that the cap 111 is provided with lugs 116 at both the top and bottom edges at the centre thereof. The body 2 may be identical with the body of the first embodiment but the rest posts may be deleted as is shown in FIG. 1*b*.

The operation of the second embodiment of the present invention is identical with that of the first embodiment except the application and removal of the cap 111. When the cap 111 is to be applied in the opening 21 it is inserted with the shoulder 14 at one end thereof entering behind the edge 15 of the body in the same way as cap 11 of the first embodiment. Next, however, the lugs 116 encounter the edges of the opening 21, that is the bottom 5 and the top surface 6, and act as a fulcrum in stead of rest posts 16 of the first embodiment. Thus, the cap 111 is bent without the centre thereof that carries the lugs 116 entering the opening 21. The cap 111 is then moved transversely so that the shoulder 14 at the one end snaps out from behind the edge 15 and the other end of the cap 111 is located inside the other edge of the body. Removal of the cap 111 is accomplished by depressing one end of the cap and performing the steps above in the reversed order in a manner similar to that of the cap 11 of the first embodiment of the present invention.

The dispenser in accordance with the invention has several advantages over the prior art as disclosed in U.S. Pat. No. US-A-3,537,422 and DE-A-27 34 664.

Firstly, the novel removable cap 11, 111 makes the drawer of DE-A-27 34 664 redundant. The insert 10 is retained in its proper position by this simple and reliable cap, thus eliminating the need of a special drawer and substantially reducing the manufacturing cost (about 25%).

Secondly, the novel locking means 13 substantially eliminates the risk of the dispenser being accidentally opened. This might occur with the prior art dispensers when handled carelessly or when in the hands of children. Thus, the security is greatly improved and the dispenser in accordance with the present invention is child-proof.

Thirdly, in the present dispenser the sides 3, 4 are transparent. This provision facilitates the handling of dispensers stacked in shelves or the like, as it is possible to identify the dispenser from the sides as well as from the bottom, which further enhances the security.

Furthermore, it is possible to use the spare parts of the dispenser according to the present invention, namely the cover 8 and the insert 10, with the prior art dispensers. Thus, some of the old spare parts do not have to be manufactured when the production is switched to the new model.

Several modifications are intended to fall within the scope of the present invention. For example, the design and the position of the recesses 19 in the covers 8 and the shoulders 18 on the beam 17 can be modified. Also, the covers 8 may be oriented longitudinally and the lockings means 13 transversely.

Thus, the invention is only limited by the claims below.

I claim:

1. A dispenser for medical preparations, such as in tablet form, of the type that shall be taken at certain times of the day and over some days, such as a week, said dispenser comprising a rectangular body having two longitudinal sides, two transverse sides, a bottom and an upper surface, said upper surface having several recesses each covered by a cover which is slidable in grooves in the upper surface to be extractable in one direction, an insert having several rows of compartments, each row being positionable below a corresponding recess in the body, each compartment housing said medical preparations, and a cap closing an opening in one of the sides of the body, said cap being removable for allowing insertion and removal of said insert through said opening in said side of the body, wherein the cap at each end thereof comprises a shoulder and wherein said one side of the body comprises two edges adapted for retaining the cap in a closed position and the cap being elastic for being pressed inward at one side so that the corresponding shoulder can pass inside the edge and the cap can be pushed in the transverse direction for bending the cap and making the other shoulder at the other end of the cap free from the corresponding other edge of the body for removal of the cap.

2. A dispenser according to claim 1, wherein the body is provided with two rest posts, extending from an interior surface of the body, for cooperation with the cap and assisting in bending the cap for removal thereof.

3. A dispenser according to claim 1, wherein the cap is provided with two lugs at the top and bottom edges at the centre thereof for cooperation with the body and assisting in bending the cap for removal thereof.

4. A dispenser according to claim 2, wherein the two rest posts assist in guiding the insert in the correct direction.

5. A dispenser according to claim 1, wherein at least one of the shoulders of the cap is serrated for providing a better finger grip.

6. A dispenser according to claim 1, wherein the insert is asymmetrical for preventing insertion in the wrong direction.

7. A dispenser according to claim 1, wherein the bottom and the transversal and longitudinal sides are transparent, so that information and identification cards are readable through the bottom and at least one of said sides.

8. A dispenser for medical preparation, such as in tablet form, of the type that shall be taken at certain times of the day and over some days, such as a week, comprising a rectangular body having two longitudinal sides, two transverse sides, a bottom and an upper surface, said upper surface comprising several recesses each covered by a cover which is slidable in grooves in the upper surface to be extractable in one direction, an insert having several rows of compartments, each row being positionable below a corresponding recess in the body, each compartment housing said medical preparations, wherein the body comprises a cap closing an opening in one of the sides of the body, said cap being removable for allowing insertion and removal of said insert through said opening in said slide of the body, the cap at each end therof comprising a shoulder, and said one side of the body comprising two edges adapted for retaining the cap in a closed position and the cap being elastic for being pressed inward at one side so that the corresponding shoulder can pass inside the edge and the cap can be pushed in the transverse direction for making the other shoulder at the other end of the cap free from the corresponding other edge of the body for removal of the cap, and the body being provided with two rest posts projecting from an interior surface of the body for cooperation with the cap and assisting in bending the cap for removal thereof.

9. A dispenser for medical preparations, such as in tablet form, of the type that shall be taken at certain times of the day and over some days, such as a week, comprising a rectangular body having two longitudinal sides, two transverse sides, a bottom and an upper surface, said upper surface comprising several recesses each covered by a cover which is slidable in grooves in the upper surface to be extractable in one direction, an insert having several rows of compartments, each row being positionable below a corresponding recess in the body, each compartment housing said medical preparations, wherein the body comprises a cap closing an opening in one of the sides of the body, said cap being removable for allowing insertion and removal of said insert through said opening in said side of the body, the cap at each end thereof comprising a shoulder, and said one side of the body comprising two edges adapted for retaining the cap in a closed position and the cap being elastic for being pressed inward at one side so that the corresponding shoulder can pass inside the edge and the cap can be pushed in the transverse direction for making the other shoulder at the other end of the cap free from the corresponding other edge of the body for removal of the cap, and the cap being provided with two lugs projecting from the top and bottom edges of the cap at the centre thereof for cooperation with the body and assisting in bending the cap for removal thereof.

* * * * *

UNITED STATES PATENT AND TRADEMARK OFFICE

CERTIFICATE OF CORRECTION

PATENT NO. : 4,872,559

DATED : October 10, 1989

INVENTOR(S) : Henrich Schoon

It is certified that error appears in the above-identified patent and that said Letters Patent is hereby corrected as shown below:

On the title page, delete (73) Assignee: Preci-Plast AB, Tollarp, Sweden".

Signed and Sealed this

Twenty-eighth Day of January, 1992

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,872,559

DATED : October 10, 1989

INVENTOR(S) : Henrich SCHOON

It is certified that error appears in the above-indentified patent and that said Letters Patent is hereby corrected as shown below:

On the title page, item [30], insert the following:

-- July 7, 1986 EPO European Pat. Off. 86109262.5 --

Signed and Sealed this

Seventh Day of February, 1995

*Attest:*

*Attesting Officer*

BRUCE LEHMAN

*Commissioner of Patents and Trademarks*